United States Patent [19]

Kofler

[11] 4,409,710

[45] Oct. 18, 1983

[54] APPARATUS FOR CLAMPING AND UNCLAMPING A WARP BEAM IN A BEAM WARPING MACHINE

[75] Inventor: Wilhelm Kofler, Uzwil, Switzerland

[73] Assignee: Maschinenfabrik Benninger AG, Uzwil, Switzerland

[21] Appl. No.: 181,490

[22] Filed: Aug. 26, 1980

[30] Foreign Application Priority Data

Sep. 21, 1979 [CH] Switzerland ..... 8533/79

[51] Int. Cl.³ ..... D02H 5/00

[52] U.S. Cl. ..... 28/196; 28/201; 242/58.6; 242/68.4

[58] Field of Search ..... 28/196, 197, 201, 208; 242/68.4, 58.6, 129.5

[56] References Cited

U.S. PATENT DOCUMENTS

| | | | |
|---|---|---|---|
| 948,806 | 2/1910 | Ball | 242/68.4 |
| 1,300,159 | 4/1919 | Glashower | 242/68.4 X |
| 2,163,010 | 6/1939 | Richards et al. | 242/68.4 X |
| 2,201,937 | 5/1940 | Wood et al. | 242/68.4 |
| 2,896,871 | 7/1959 | Woodruff | 242/68.4 X |
| 3,063,123 | 11/1962 | Noe | 28/196 |
| 3,331,318 | 7/1967 | Augustyn et al. | 242/68.4 X |
| 3,584,808 | 6/1971 | Staples et al. | 242/68.4 |
| 4,098,468 | 7/1978 | Skalleberg | 242/68.4 X |

FOREIGN PATENT DOCUMENTS

| | | | |
|---|---|---|---|
| 47-19105 | 9/1972 | Japan | 242/68.4 |

*Primary Examiner*—Robert Mackey

*Attorney, Agent, or Firm*—Werner W. Kleeman

[57] ABSTRACT

The centering and entrainment devices, by means of which the warp beam can be clamped or chucked, are axially slidably guided at side plates of the beam warping machine. With their outer ends they are hingedly connected at a respective lever. Both of the levers are pivotably mounted, by means of their one end about stationary pivot pins, in a plane which contains both of these pivot points as well as the axis of the warp beam. At their opposite ends both of the levers are interconnected by a rod arrangement, wherein a threaded sleeve having two opposite internal threads and rotatably mounted in one side plate allows changes in the length of such rod arrangement. Consequently, both of the levers can be synchronously and axially symmetrically moved towards and away from one another, so that the coaxially guided centering and entrainment devices can be symmetrically advanced towards and displaced out of the warp beam.

7 Claims, 6 Drawing Figures

I
II
III

APPARATUS FOR CLAMPING AND UNCLAMPING A WARP BEAM IN A BEAM WARPING MACHINE

CROSS REFERENCE TO RELATED CASE

This application is related to my commonly assigned, copending U.S. application Ser. No. 06/181,489, filed Aug. 26, 1980, entitled "Apparatus for a Beam Warping Machine for Lifting-in and Lifting-out the Warp Beam and for Feeding and Uniformally Pressing the Contact Roll against the Warp Beam During Operation of the Machine and for Lift-off of the Contact Roll".

BACKGROUND OF THE INVENTION

The present invention relates to a new and improved construction of apparatus for clamping and unclamping a warp beam in a beam warping machine.

Generally speaking, the chucking and dechucking apparatus of this development is of the type comprising a centering and entrainment device which is arranged at the inner end of two stub shafts mounted to be axially displacable in side plates of the beam warping machine.

Equipment of this type which is used at beam warping machines are generally known to the art. The warp beam is provided at its ends with stub shafts or recesses, advantageously conical recesses, with which coact the correspondingly constructed ends of the centering and entrainment device in one axially displaced position, in order to remove an empty warp beam which has been raised by the lifting-in and lifting-out device from the latter, for centering such empty beam and coupling the same with a rotary drive. The centering and entrainment device is brought into the other axially displaced position, so that the wound warp beam can be lifted-out and replaced by an empty warp beam. During the warping operation a press or contact roll is pressed against the outer surface or jacket of the warp beam or the warp threads which have been wound thereon, as the case may be, this contact or press roll ensuring for a uniform density of the package of warp threads which have been wound onto the warp beam.

This press roll must be arranged exactly parallel to the axis of the warp beam and between its beam discs. This requires considerable accuracy in the positioning of the clamped or chucked warp beam.

From German Patent Publication No. 1,535,168 there is known to the art an apparatus of the previously mentioned type, wherein the warp beam provided with journals at its ends is supported and entrained by means of such journals by stub shafts which are mounted to be rotatable and axially displacable in the machine frame. The mounting arrangement is accomplished by means of special bearings containing internally threaded sleeves or bushings which are threaded on to externally threaded bushings or sleeves. By rotating the internally threaded bushing, connected with a stub shaft, upon the externally threaded bushing, connected with the machine frame, it is possible to axially shift the stub shaft. The stub shafts supporting the warp beam are thus connected with separate devices for performing axial displacements in order to release and advance the centering and entrainment device as well as for positioning the chucked or clamped warp beam. These separate devices must be activated individually by hand or by means of motors through the air of special drive elements, in order to be able to chuck or release the warp beam. For the lateral adjustment of the warp beam, both of the displacement devices can be coupled with one another and can be conjointly actuated by a manual or mechanically driven drive device. This requirement that the clamping devices at both sides of the warp beam be separately actuated is time-consuming, and furthermore, associated with the danger that the contact or press roll will not be introduced between both of the warp-beam discs, something which can lead to appreciable damage of the equipment.

Similar, likewise purely mechanical devices for clamping or unclamping a warp beam have also been disclosed in German Pat. No. 1,102,660 and German Utility Model No. 7,312,497. Also, in this case, threaded bushings or sleeves are used for the axial displacement in order to advance the centering and entrainment device.

In order to preclude the danger that the position of the warp beam will be improperly estimated and to reduce the set-up time, it has been proposed according to German Patent Publication No. 2,450,757, where there has been disclosed an apparatus of the previously mentioned species, to axially displace with a motor drive the centering and entrainment devices at both sides of the warp beam and to provide an electrical control device which coacts with measuring devices for determining the position of the warp beam. This control device is capable of automatically delivering control signals for the activation of the adjustment drives of the bearing shafts. The adjustment drives are constructed as piston-and-cylinder drives, wherein, in each case, the piston rod of a cylinder forms the axially displacable bearing shaft for the warp beam. Also, this prior art reference teaches the use of separate displacement devices to both sides of the warp beam, and in particular there is disclosed an arrangement whose construction is quite complicated in order to ensure for a proper positioning and chucking of a warp beam.

The immediately discussed prior art equipment has been improved upon with a construction as disclosed in the German Patent Publication No. 2,628,788 wherein there is used in lieu of one of both piston-and-cylinder drives, an electric motor which is coupled by means of its bearing shaft, through the agency of an adjustment securing device which is effective in rest condition, especially by means of a screw drive, with a self-locking worm. Additionally, the displacement of the bearing shaft which is hydraulically displacably mounted in the side plate, here is accomplished differently than with the device disclosed in the previously mentioned German Pat. No. 2,450,757, and specifically, such displacement is undertaken by means of a lever arranged externally of the related side plate. This lever is pivotably mounted at its one end by means of a support at the side plate and at its other end is connected with the piston rod of the piston-and-cylinder drive and at which there is hingedly connected approximately at its center the bearing shaft.

The equipment of this prior art reference therefore again contains two separate advance or feed devices requiring a correspondingly great constructional expenditure.

The previously discussed prior art apparatuses, apart from the drawback of considerable constructional expenditure required for the displacement devices which are separately provided at each side of the warp beam, have common to them the further disadvantage that the feed or advance of the centering and entrainment devices towards the warp beam can hardly be accomplished in synchronism because of the separate displacement devices. As a result, as a rule the warp beam must be chucked while shifted out of the correct center position towards the side of the least resistance, and only thereafter the installation must be further adjusted.

SUMMARY OF THE INVENTION

Therefore, with the foregoing in mind it is a primary object of the present invention to provide a new and improved construction of apparatus for clamping and unclamping a warp beam in a beam warping machine in a manner not afflicted with the aforementioned drawbacks and limitations of the prior art constructions heretofore discussed.

Another and more specific object of the present invention aims at providing a new and improved construction of apparatus of the previously discussed type which, in relation to heretofore known equipment of such type, affords an appreciable structural simplification and by means of which it is possible to positionally centrally chuck or clamp each warp beam always in an automatic manner and without the need to resort to measuring elements or without requiring safety elements, in other words, each newly chucked or clamped warp beam assumes exactly the same position as a previously chucked and a subsequently chucked warp beam of the same dimensions.

Now in order to implement these and still further objects of the invention, which will become more readily apparent as the description proceeds, the chucking and unchucking apparatus of the present development is manifested by the features that the stub shafts are each hingedly connected to a respective one of two levers located in one plane, and that a device is provided in order to simultaneously synchronously and axially symmetrically pivot these levers both towards one another and away from one another.

An advantageous and particularly simple construction of the inventive apparatus resides in the fact that the device for pivoting the levers about their related pivot axis comprises a threaded sleeve which is rotatably mounted in a stationary part of the machine. This threaded sleeve has oppositely threaded internal threads or threading in which there are inserted threaded spindles extending parallel to a connection line extending between the pivot axes or shafts of the levers. These threaded spindles are each hingedly connected with one of both levers.

It is advantageous to mount the threaded sleeve in a side plate of the machine and one of the threaded spindles is directly hingedly connected at the closer situated lever, whereas the other threaded spindle is hingedly connected by means of an intermediately arranged, pivotable protective frame with the furthest situated other lever.

If additionally, for instance, the point of rotation of the lever is secured to an existing pivot shaft having other functions and which extends through the machine parallel to the lengthwise axis of the warp beam, then there is realized a construction of the inventive apparatus which can be utilised to a great extent with already existing machine elements, resulting in a saving in cost and affording a simple construction which allows for good visual access and minimum impairment of the accessibility of the machine parts.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2:
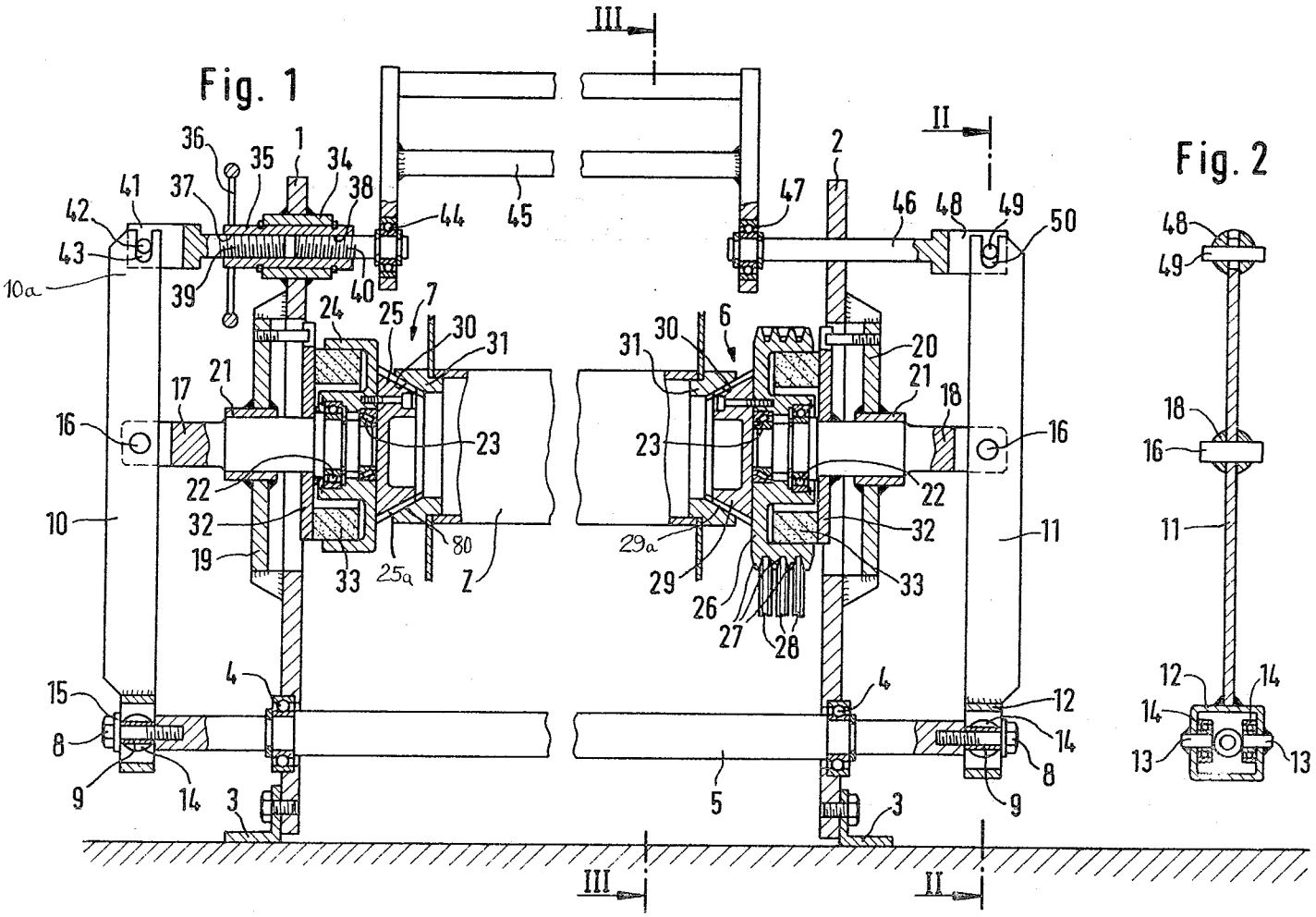
FIG. 1 is a sectional view through an exemplary preferred embodiment of the inventive apparatus taken in a plane containing the axis of rotation of the warp beam and showing the warp beam in its chucked or clamped condition.
FIG. 2 is a cross-sectional view of the arrangement of FIG. 1, taken substantially along the line II—II thereof.
Figure 3:
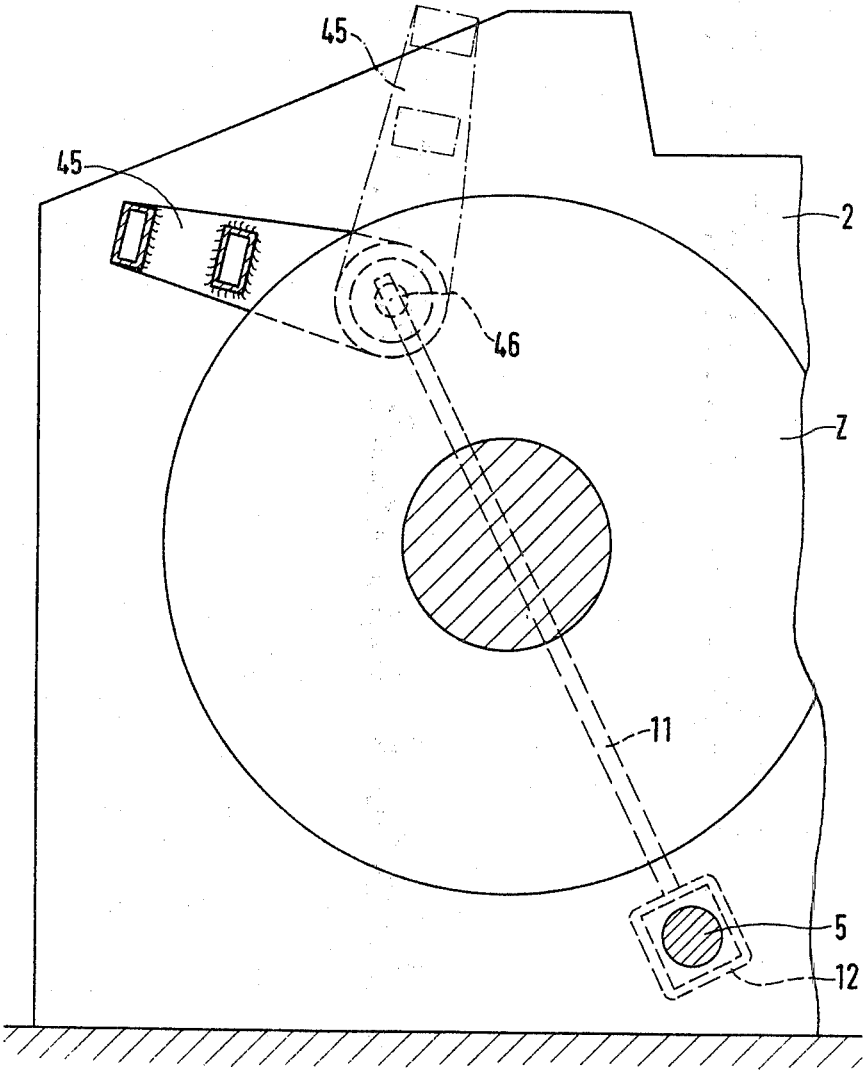
FIG. 3 schematically illustrates a sectional view of the arrangement of FIG. 1, taken substantially along the line III—III thereof.

Describing now the drawings, and turning attention specifically to FIG. 1 reference characters 1 and 2 designate both of the side or cheek plates of a beam warping machine which is bolted to the floor or ground in a vibration-dampening fashion by means of base angle members 3 or equivalent structure. Between both of these side plates 1 and 2 there extends, close to the ground, a pivot shaft 5 which is mounted to be freely rotatable in standard bearings 4. This pivot shaft 5 forms a part of the apparatus for lifting-in and lifting-out the warp beam Z by means of not particularly illustrated lifting forks connected for rotation with such pivot shaft 5. These lifting forks, upon actuation of a likewise not particularly illustrated rod arrangement serving to rotate the pivot shaft, raise from the ground a warp beam which has been rolled into the lifting forks, up to the region of the centering and entrainment devices 6 and 7 which have been shifted axially towards the outside at both sides of the machine in order to chuck the thus raised warp beam and to again lower such warp beam upon completion of the warping operation. The function and mode of operation of such elements which are not important for understanding the underlying principles and teachings of the present development, and therefore for reasons of clarity in the illustration of the drawings have not been particularly shown, have been disclosed for instance in the aforementioned copending, commonly assigned United States application, to which reference may be readily had and the disclosure of which is incorporated herein by reference.

At the ends of such rotatable but non-displaceable shaft 5 mounted in the side plates 1 and 2 there is attached for rotation to such shaft 5, externally of such plates 1 and 2, by means of the screws or threaded bolts 8, a respective bushing or sleeve 9. At this location, there is pivotably connected a respective solid lever 10 and 11 in a plane containing the lengthwise axis of the shaft 5. Each such lever 10 and 11 carries at its related end a bearing head 12 formed by a square or four cornered tubular section. Within each bearing head 12, there is arranged a pair of pins or plugs 13 provided with ball bearings 14 which are retained between the end surface of the shaft 5 and a related disc or shim 15. At the central region of its length, each of the levers 10 and 11 has piercingly extending therethrough a pin 16 at which there is hingedly connected the outer end of a stub shaft 17 and 18 of the centering and entrainment device or means for the warp beam Z. The stub shafts 17 and 18 extend through the side plates 1 and 2, respectively, and are guided essentially parallel to the shaft 5.

In order to provide favourable design conditions, especially as small as possible spacing of the side plates 1 and 2 from one another, both of these side plates 1 and 2 have openings at the region of throughpassage of the related stub shafts 17 and 18 and are provided at the left and right of such side plates 1 and 2 and their related not particularly referenced openings with a related mounting element 19 and 20, respectively, which is mounted from externally of the related side plates 1 and 2. These mounting elements 19 and 20 are provided with guide bushings or sleeves 21 for enabling an axially displacable guiding of the stub shafts 17 and 18. At the end of the stub shaft 17 protruding between the side plates 1 and 2, there is mounted to be freely rotatable, by means of a ball bearing 22 and a tapered ball bearing 23, or equivalent anti-friction bearing means, a bearing disc 24 which supports an axially protruding entrainment member 25 equipped with bevel gear teeth, generally indicated by reference character 25*a*. The coaxial oppositely situated end of the stub shaft 8 supports in analagous fashion, by means of a ball bearing 22 and a tapered ball bearing 23, a drive pulley or disc 26 which carries at its circumference ribs 27 or the like for receiving a suitable pulley belt 28 driven by a not particularly illustrated but conventional machine drive. Just as was the case for the bearing or support disc 24 at the opposite side, here also the drive pulley or disc 26 carries a conical entrainment member 29 equipped with bevel gear teeth, generally indicated by reference character 29*a*.

In the position of the parts as shown in FIG. 1, the warp beam Z is clamped or chucked, and the conical entrainment members 25 and 29 protrude at both sides into appropriately configured, here in the form of conical recesses or depressions 30 of the lateral beam heads or end portions 31. This type of self-centering clamping or chucking of so-called journaless warp beams is known and therefore need not here be further discussed. What has been further shown however are the brake plates 32 arranged to both sides of the warp beam Z. These brake plates 32 are equipped with brake elements 33 which act upon the inner surfaces of the brake-drum like constructed bearing disc 24 and drive disc or pulley 26, respectively.

At the upper end region of the side plate 1, located opposite the bearing arrangement 4 of the shaft 5, there is affixed, for instance by welding, a sleeve 34. Within the sleeve 34, there is mounted to be rotatable but axially non-displaceable a second sleeve 35 which can be turned by means of a handwheel 36. The second sleeve or bushing 35 is provided with two opposite pitch internal threads or threading 37 and 38, for instance left-hand threading and right-hand threading. Inserted into the threaded sleeve 35 from both sides thereof is a respective threaded spindle 39 and 40. The threaded spindle 39 has been shown inserted into the left-hand side of the threaded sleeve 35 while the other threaded spindle 40 has been shown inserted from the right-hand side of such threaded sleeve 35. Rotation of the handwheel 36 therefore causes a uniform coaxial displacement of the threaded spindles 39 and 40 either towards one another or away from one another.

The outer end of the spindle 39 carries a spindle head 41 which is hingedly connected by means of a pin 42 in a recess 43 of the upper end 10*a* of the lever 10. The outer end of the second threaded spindle 40 carries a ball bearing 44 by means of which there is pivotably connected the one side of a protective frame 45 with the shaft of the threaded spindle 40 serving as the pivot axis.

At the opposite side of the machine, there is axially displaceably guided, coaxially with respect to the threaded spindle 40, a shaft 46 in the side plate 2. This shaft 46 carries at its inner end a ball bearing 47, which analagous to the ball bearing 44, pivotably mounts the other side or end of the protective frame 45 or equivalent structure. At its outer end the shaft 46, just like the threaded spindle 39, is hingedly connected by means of a head portion or head 48 and a pin 49 in a recess 50 of the lever or lever member 11.

The function and mode of operation of the protective frames or guards mounted at different locations of winding machines for reasons of safety and for operating the machine, analagous to the illustrated protective frame or guard 45, can be assumed to be well known in this technology and therefore need not here be further discussed, particularly since the same is unimportant for understanding the basic teachings of the present invention. What is only of importance in this respect is that this protective frame or guard 45 is incorporated, as an advantageous structural simplification in the design of the machine, into the movement transmission rod arrangement of the device for lifting-in and lifting-out the warp beam Z, and specifically, in a manner such that it transmits axial movements of the threaded spindle 40 to the shaft 46 as if the latter were continuously connected with the former.

The mode of operation of the described apparatus now will be explained in greater detail based upon the illustration of FIGS. 4 and 5.

Figure 4:
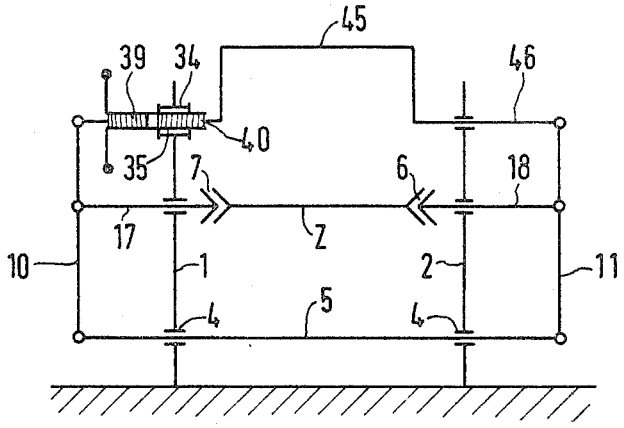
FIGS. 4, 5 and 6 are respective schematic illustrations portraying the mode of operation and the possibilities afforded by the inventive apparatus.

In FIG. 4, there has been illustrated the position of the parts corresponding to those shown in FIG. 1 i.e., the warp beam Z is shown chucked or clamped in the centering and entrainment device.

Figure 5:
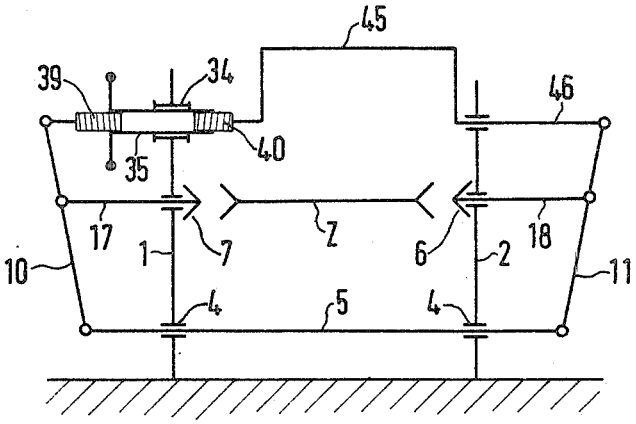

Now if after completion of the warping operation the full warp beam should be replaced by an empty warp beam, then the operator rotates the handwheel 36 in that directional sense which causes both of the threaded spindles 39 and 40 to move coaxially away from one another into the position shown in FIG. 5. Consequently, both of the levers or lever members 10 and 11 are pivoted outwardly about their pivot axes formed by the pins 13 at the shaft 5, in the pivot plane containing the pivot shaft 5 and the lengthwise axis of the warp beam Z, this plane constituting the image plane of the illustration of FIGS. 4, 5 and 6. Hence, also the stub shafts 17 and 18 are moved coaxially away from one another and together therewith the entrainment members or entrainment means 25 and 29 which thus depart from the conical recesses 30 of the warp beam Z and, therefore, as best seen by reverting to FIG. 5, release such warp beam Z. The full warp beam now bears upon the not particularly illustrated lifting forks of its lifting-in and lifting-out device and can be lowered by such device down to the ground and thereafter transported away. Now an empty warp beam is rolled onto the lift forks and in the manner described in the aforementioned copending United States application, by pivoting the pivot shaft 5 this empty warp beam can be raised up to the operating region of the centering and entrainment devices 6 and 7.

Now if the operator turns the handwheel 36 in the opposite direction of rotation, then, both of the threaded spindles 39 and 40, and thus, also both of the lever members 10 and 11, and by virtue of the movement of such levers or lever members 10 and 11, both of the centering and entrainment devices 6 and 7 are moved towards one another. Hence, the entrainment members 25 and 29 of the centering and entrainment devices 6 and 7 move into the conical recesses or depressions 30 of the warp beam Z. The internal conical-shaped end portions 80 of the warp beam Z assume the function, in conventional manner, of exactly automatically centering the warp beam Z, whereas the bevel teeth 25*a* and 29*a* of the entrainment members 25 and 29, respectively, likewise arranged to both sides of the warp beam Z ensure for its positive rotational entrainment and braking. However, in contrast to the separate infed or advanced centering and entrainment devices of the prior art, with the described apparatus there is ensured that simultaneously and, in any case, the warp beam Z will be symmetrically chucked or clamped at the center between both of the entrainment members 25 and 29 and also will again be released in this position. Since, therefore, each chucked warp beam Z of the same dimension, following the chucking or clamping operation, assumes exactly the same position as a previously chucked warp beam and a subsequently chucked warp beam, and since lateral displacements of the end positions cannot arise, there are beneficially dispensed with all of the time-consuming measures for aligning a clamped warp beam with respect to a warping comb and/or the press roll.

Figure 6:
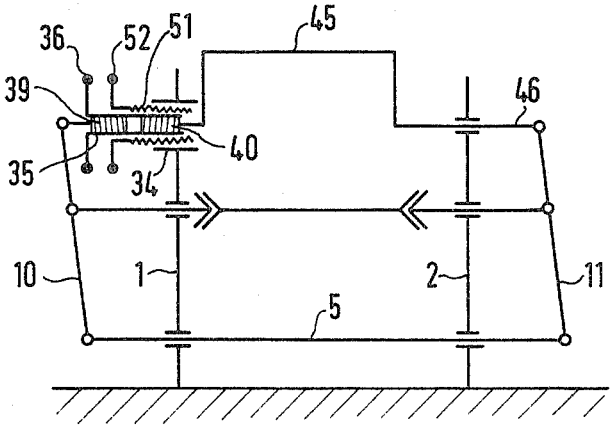

If, however, such lateral adjustability of a clamped or chucked warp beam is desirable, for instance when using warp beams having different spacings between the beam heads and beam discs or plates at both ends, then such can be realized without any great expenditure in the manner indicated schematically in FIG. 6. If there are provided means, with the aid of which it is simultaneously possible to pivot both of the levers 10 and 12 of the hinge parallelogram arrangement formed by the elements 5, 10, 11 and 39, 40, 45 and 46, in the same direction through the same angle about their pivot axis at the shaft 5, then by means of this parallel guide arrangement of the stub shaft 17 and 18, it is possible to displace, as shown in FIG. 6, axially towards the left or right, somewhat out of its central position, a chucked warp beam. The same FIG. 6 also shows a possible arrangement by means of which this can be realized in a most simple manner. It is sufficient for this purpose to provide the threaded sleeve 35 additionally with an external threading and to mount such in the bushing 34 by means of a further threaded sleeve 51 which can be rotated by a handwheel 52. By rotating this handwheel 52 it is possible to axially displace as a unit the threaded sleeve 35.

Of course, instead of the manual operation of the handwheels 36 and/or 52 there could be employed a motor drive.

Apart from the already discussed advantages, the described inventive apparatus, in contrast to comparable state-of-the-art apparatuses, possesses an entire spate of further notable advantages.

Since by virtue of the rotation of the warp beam and its weight, appreciable forces act upon the parts of the centering and entrainment devices 6 and 7, the enclosed force parallelogram or rod arrangement formed by the inventive apparatus is particularly suitable for taking-up such forces. Its elements are predominantly loaded in tension, so that they nonetheless can be designed as lightweight components.

Due to the incorporation of existing elements, such as for instance the pivot shaft 5 and the protective frame or guard 45, it is not only possible to save costs in the design of the equipment, but also there is ensured for really good visual access to the components of the machine.

Since the side plates 1 and 2 practically only carry out support functions, these also may be designed as lightweight components. The clamping forces are taken-up by the hinge parallelogram arrangement as are equally the lateral vibrations.

The construction of the threaded sleeve 35 as a self-locking spindle nut member affords an optimum protection of the operator against warp beams which unintentionally detach from the centering and entrainment devices, something which could not be realized when working with prior art pneumatic or hydraulically infed or advanced centering and entrainment devices.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for clamping and unclamping a warp beam in a beam warping machine, comprising:

a beam warping machine;

centering and entrainment means provided for said warp beam for supporting said warp beam in said beam warping machine;

two axially displaceably mounted stub shafts;

each of said stub shafts having an inner end cooperating with said centering and entrainment means;

two levers located in a predetermined plane;

each of said levers having opposed ends;

means for hingedly connecting each stub shaft with a related one of said levers between the opposed ends thereof;

means for synchronously and axially symmetrically pivoting said levers simultaneously towards and away from one another;

means including said two levers and said pivoting means for said two levers for defining a closed hinge parallelogram arrangement;

said closed hinge parallelogram arrangement having two pairs of opposite substantially parallel sides;

said two levers forming one of the pairs of said opposite substantially parallel sides of said closed hinge parallelogram arrangement;

the other pair of opposite parallel sides of said hinge parallelogram arrangement having a first side containing at opposite ends thereof pivot shaft means for said two levers; and said other pair of opposite parallel sides having a second side containing said means for synchronously and axially symmetrically pivoting said levers simultaneously towards and away from one another.

2. The apparatus as defined in claim 1, further including:

side plate means at which there are mounted said stub shafts.

3. An apparatus for clamping and unclamping a warp beam in a beam warping machine, comprising:

a beam warping machine;

centering and entrainment means provided for said warp beam for supporting said warp beam in said beam warping machine;

two axially displaceably mounted stub shafts;

each of said stub shafts having an inner end cooperating with said centering and entrainment means;

two levers located in a predetermined plane;

means for hingedly connecting each stub shaft with a related one of said levers;

means for synchronously and axially symmetrically pivoting said levers simultaneously towards and away from one another;

said beam warping machine contains a stationary part;

said means for pivoting said levers comprises a threaded sleeve rotatably mounted in said stationary part of the beam warping machine;

means for pivotably supporting said levers for pivotal movement about a related pivot shaft;

said threaded sleeve serving to pivot each of said levers about its related pivot shaft;

said threaded sleeve having opposite internal threads;

threaded spindles inserted into meshing engagement with the opposite internal threads of said threaded sleeve;

said threaded spindles extending essentially parallel to a connection line between said pivot shafts of said levers; and means for hingedly connecting each threaded spingle with a related one of both levers.

4. The apparatus as defined in claim 3, wherein:

said stationary part of said beam warping machine comprises a side plate in which there is mounted said threaded sleeve;

one of said threaded spindles being directly hingedly connected at its related lever; and pivotal protective means for hingedly connecting the other threaded spindle with the other lever.

5. The apparatus as defined in claim 4, wherein:

said protective means comprises a protective frame arranged between said levers.

6. The apparatus as defined in claim 3, wherein:

said means for pivotally supporting said levers comprises a pivot shaft member at which there are secured said pivot shafts of said levers.

7. The apparatus as defined in claim 6, wherein:

said pivot shaft member extends across the beam warping machine essentially parallel to the lengthwise axis of the warp beam.

* * * * *